US006884203B2

(12) United States Patent
Forcillo

(10) Patent No.: US 6,884,203 B2
(45) Date of Patent: Apr. 26, 2005

(54) ABDOMINAL BENCH WITH CONSTANT GAP TORSO CUSHION

(75) Inventor: John Forcillo, Laval (CA)

(73) Assignee: J.E.M. Concept International Inc., Mascouche (CA)

( * ) Notice: Subject to any disclaimer, the term of this patent is extended or adjusted under 35 U.S.C. 154(b) by 0 days.

(21) Appl. No.: 10/440,566

(22) Filed: May 19, 2003

(65) Prior Publication Data

US 2004/0235625 A1 Nov. 25, 2004

(51) Int. Cl.[7] ..... A63B 26/00

(52) U.S. Cl. ..... 482/142; 482/140; 482/148; 482/91; 482/907; 482/908

(58) Field of Search ..... 482/140, 142, 482/91, 907, 908

(56) References Cited

U.S. PATENT DOCUMENTS

| | | | | |
|---|---|---|---|---|
| 5,346,447 | A | | 9/1994 | Stearns |
| 5,665,041 | A | | 9/1997 | Hsieh |
| 5,692,997 | A | | 12/1997 | Stearns |
| 5,769,766 | A | | 6/1998 | Huang |
| 5,938,575 | A | | 8/1999 | Stearns |
| 5,993,360 | A | | 11/1999 | Stevens |
| 6,013,882 | A | * | 1/2000 | Boetzkes ..... 200/86.5 |
| 6,206,809 | B1 | | 3/2001 | Habing et al. ..... 482/96 |
| 6,471,624 | B1 | * | 10/2002 | Voris ..... 482/142 |
| 6,544,154 | B2 | * | 4/2003 | Forcillo ..... 482/142 |
| 6,645,129 | B2 | * | 11/2003 | Eschenbach ..... 482/140 |

* cited by examiner

*Primary Examiner*—Danton D. DeMille
*Assistant Examiner*—L. Amerson
(74) *Attorney, Agent, or Firm*—Davidson Berquist Jackson & Gowdey LLP

(57) ABSTRACT

A unique abdominal bench with a pivoting torso section has a number of pivots, rods, and levers that allow the fixed seat section of the abdominal bench to remain a constant distance from the pivoting torso section during an abdominal exercise. The leg section of the abdominal bench pivots towards the abdomen, as does the torso section when the torso is raised. The leg section is pivotably connected to the torso section through a number of rods, pivots and levers such that the gap between the seat and torso section remains the same. A push rod is connected to the pivoting leg brace and is in turn connected to a torso bracket through several guide rods and a dog-leg lever. The push rod, guide rods and the dog-leg lever allow the torso section to remain a constant distance from the fixed seat section. Allowing the torso and seat section to remain a constant distance eliminates the pressure on the lower body of the exerciser and will not cause any movement of the lower body of the exerciser with respect to the torso section.

25 Claims, 4 Drawing Sheets

ABDOMINAL BENCH WITH CONSTANT GAP TORSO CUSHION

BACKGROUND OF THE INVENTION

This invention relates generally to the field of exercise equipment. More particularly, an abdominal bench is presented which has a unique system of pivots that increases the effectiveness of the abdominal exercise by maintaining the distance between the torso and seat cushions.

In the field of exercise equipment, abdominal benches have been previously utilized to exercise the abdominal muscles. Essentially, an abdominal bench is a short bench having at least one cushion. The exerciser would lie on the abdominal bench and do sit-ups, also known as abdominal crunches. Several benches have been devised to increase the effectiveness of the exercise.

The most common abdominal bench has one cushion to support both the torso and seat of the exerciser. More sophisticated benches have separate cushions for the torso and seat of the user. To utilize the bench, the exerciser would place his or her lower body on one seat cushion while his or her upper torso would rest on the torso cushion. The upper torso portion of the abdominal bench may pivot about a single pivot point. When the exerciser grasps the handles at the top end of the exercise bench and pulls himself upward, he accomplishes an abdominal crunch exercise. Repeating the exercise allows one to tone and strengthen the abdominal muscles.

One of drawbacks with these standard abdominal benches is that the single pivot point for the torso section pushes the torso section towards the lower portion of the body at the same time as the exerciser is doing the abdominal exercise. This forward motion of the torso also moves the lower portion of the exerciser's body. This motion reduces the effectiveness of the abdominal exercise. It is an object of this invention to eliminate the pushing of the torso towards the seat in an abdominal exercise.

Other abdominal benches have a footrest in addition to the seat and torso and handle portions of the bench. In accomplishing an abdominal exercise using this particular device, the exerciser would pull inwardly with his legs as well as pulling upwardly with his torso to accomplish the abdominal exercise. This exercise has been found to be effective. However, one drawback in the single pivot torso abdominal bench with footrests is that the torso section pushes on the lower body section thus decreasing the effectiveness of the exercise.

It would be highly desirable to have an abdominal bench utilizing both handles and footrests and a pivoting torso section, where the torso section and fixed seat section remained a constant distance from each other. Maintaining the constant gap between the torso and fixed seat cushions eliminates the movement of the torso section of the exerciser's body towards the seat, and hence the lower portion of the exerciser's body. It is an object of this invention to provide an abdominal bench where the pivoting torso section of the bench and the fixed seat section of the bench remain a constant distance apart. It is another object of this invention to provide a pivoting abdominal bench such that the movement of the upper torso section of the exerciser does not also force movement of the lower section of the exerciser.

In order to keep a constant gap between the upper torso cushion and the fixed seat cushion, a distinct system of pivots has been devised. The pivot system eliminates the movement of the lower seat section of the exerciser as the upper torso section of the exerciser is moved forward. Keeping this same gap, there is little or no pressure exerted on the legs, and hence the footrest section of the exerciser, when the upper torso is lifted. It is a still further object of this invention to provide an effective abdominal exercise such that the movement of the upper torso section does not force movement in the lower seat and leg section of the exerciser.

Other and further objects of this invention will become apparent upon reading the below described specification.

BRIEF DESCRIPTION OF THE PREFERRED EMBODIMENT

A pivoting abdominal bench has a fixed seat section and a pivoting upper torso section. The bench also has a pivoting leg and footrest section. The lower end of the leg and footrest section is connected to a push rod. The push rod is connected to the lower end of the pivoting torso section. At least one guide rod is pivotably connected between the frame and a dog-leg lever. The dog-leg lever is pivotably connected to the lower part of the torso section. The arrangement of the rods, levers and pivots allows the exerciser to pivot the upper torso section upward while pivoting the leg and feet inwardly toward the abdomen. Due to the unique pivot system and the connection of the foot and leg rest to the torso section through the push rod, the torso section remains a constant distance from the seat section during the exercise. The constant gap between the pivoting torso section and the fixed seat section eliminates any pressure on the lower portion of the body that could result from the raising of the torso during the exercises.

DESCRIPTION OF THE DRAWING FIGURES

DETAILED DESCRIPTION OF THE PREFERRED EMBODIMENT

An abdominal bench for body crunch exercises comprises two U-shaped frame braces 1 and 1', having front 2 and rear 2' horizontal foot braces. The U-shaped and horizontal bases form the essential frame for the abdominal bench.

Figure 1:
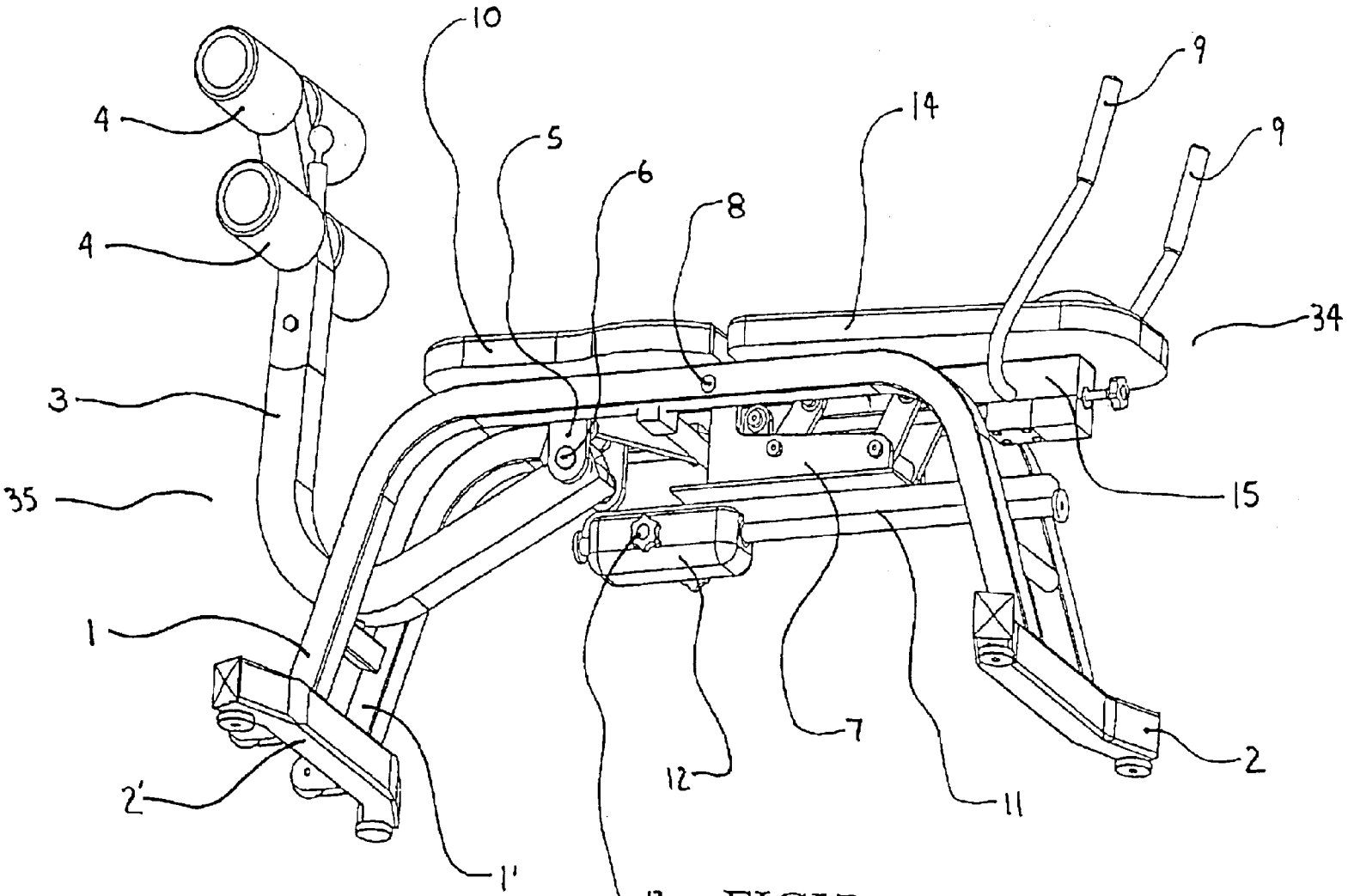
FIG. 1 is a perspective view of the abdominal bench showing the bench in the horizontal position.

Attached to the U-shaped brace 1 is a leg and footrest brace 3, as shown in FIG. 1. At the upper portion of the leg and footrest brace 3 are a plurality of foot cushions 4. The exerciser would place his feet and ankles on or around the cushions 4 to perform the abdominal exercise.

Figure 2:
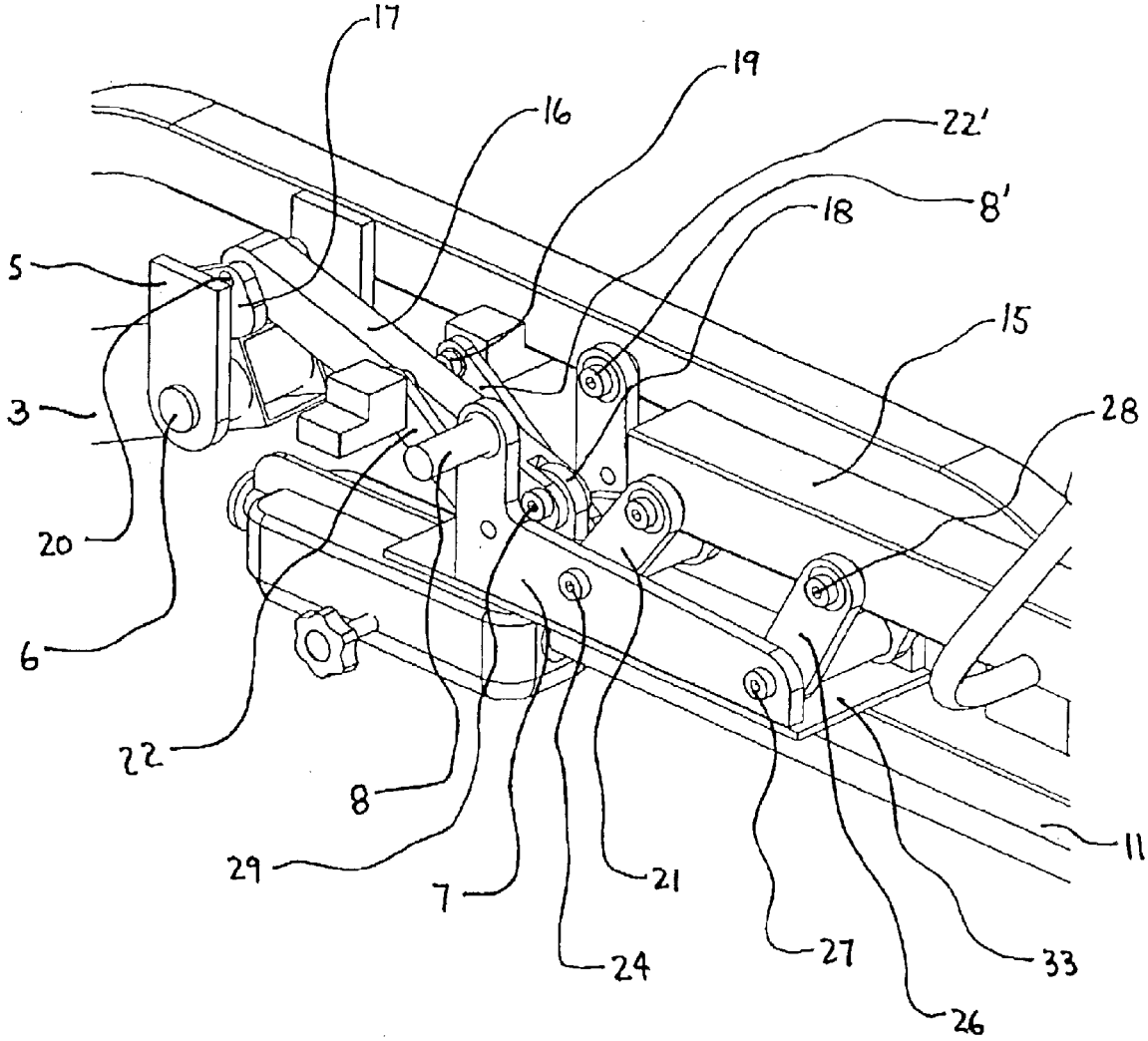
FIG. 2 is a partial perspective view of the pivoting system of the abdominal bench, showing the pivoting connections between the leg and footrest brace and the upper torso pivoting section.

A footrest pivot bracket 5, as shown in FIGS. 1 and 2, connects the leg and footrest brace 3 to the U-shaped frame brace 1. Each U-shaped frame brace 1 and 1' has a footrest bracket 5 attached thereto. The leg and footrest brace 3 is thus pivotably connected to the frame at pivot point 6, as best shown in drawing FIGS. 1 and 2.

Figure 3:
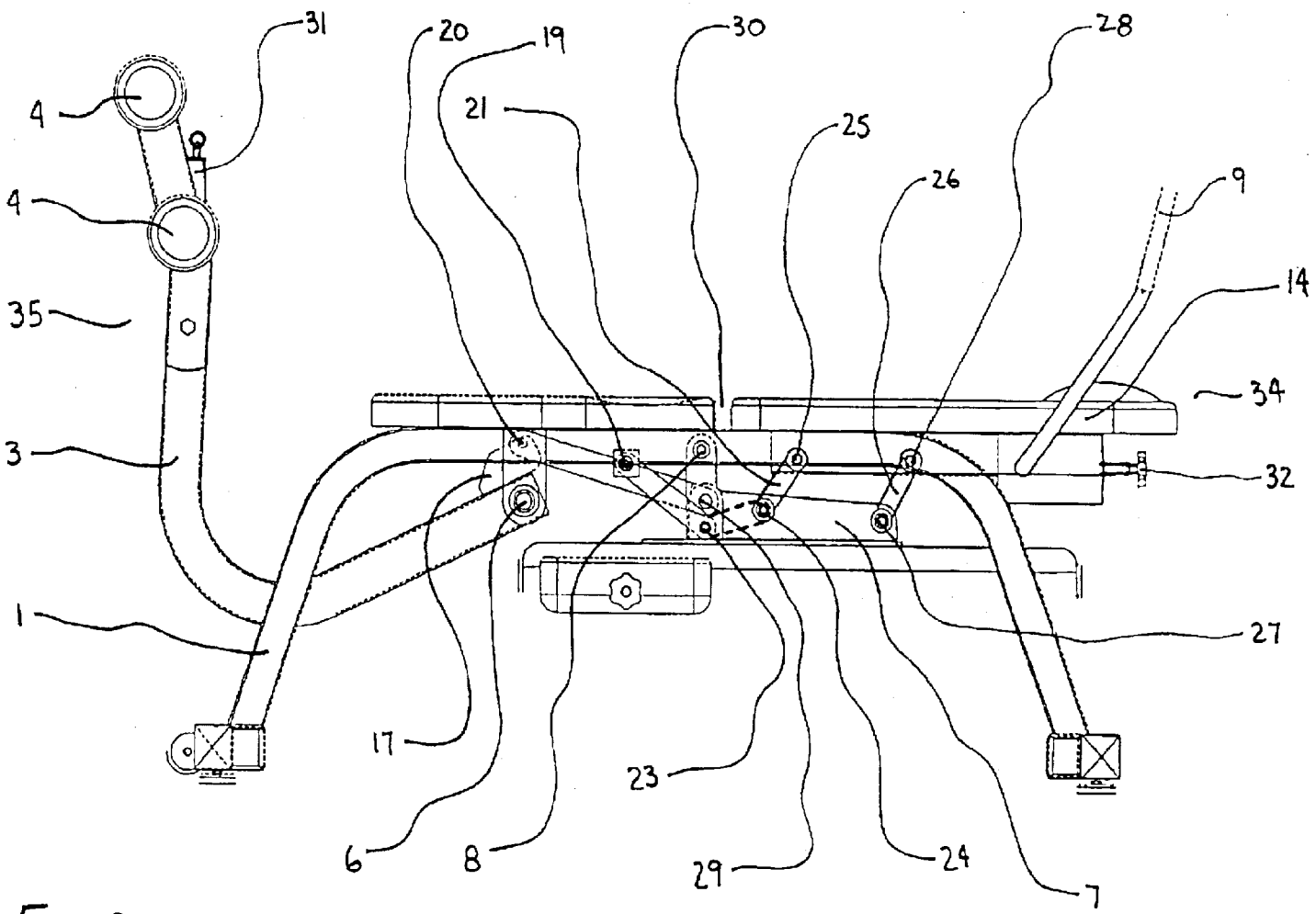
FIG. 3 is a side view of the abdominal bench, showing the pivoting system in the horizontal position.

An L-shaped torso bracket 7 connects the pivoting torso section to the U-shaped frame braces 1 and 1'. This L-shaped torso bracket 7 is pivotably connected to the left and right U-shaped braces at torso upper pivot points 8 and 8', as best shown in FIGS. 1 and 2. The pivoting torso section also has adjustable handles 9 connected near the head end 34 of the bench, as best shown in FIGS. 1 and 3.

The abdominal bench has a fixed seat 10 attached to left and right U-shaped frame braces. This seat is fixed to the braces and does not pivot or move.

An additional feature of this particular abdominal bench includes an adjustable weight 12. Attached to the lower section of the L-shaped torso bracket 7 is a weight arm plate 33, as best shown in FIG. 2. An adjustable weight arm 11 is attached on the bottom of weight arm plate 33 and is parallel to the U-shaped frame braces 1 and 1'. Attached to the bottom to the adjustable weight arm 11 is an adjustable weight 12. This adjustable weight 12 may be moved to either side of the main torso pivot point 8 by sliding the adjustable weight 12 along weight arm 11 and then locating the weight in the desired position using the adjustable weight tightening wheel 13. This adjustable weight mechanism is a feature of this particular bench, but has been the subject of other patent applications by the instant inventor.

The upper torso cushion 14, as shown in FIG. 1, is fixedly attached to the top of the torso cushion brace 15. Handles 9 are also attached to the pivoting torso section near the head end 34 of the torso cushion brace 15. The handles 9, brace 15, and torso cushion 14 all pivot about torso pivot point 8 during the exercise.

The pivoting system described herein has, as its major object, maintaining the gap 30 between the fixed seat 10 and the torso cushion 14 at a constant distance. Keeping this gap 30 constant between the fixed seat cushion 10 and the torso cushion 14 provides that pressure exerted by the exerciser in lifting his torso and drawing his feet and legs toward his abdomen, thus exercising his abdominal muscles, will not force the torso towards the seat and leg part of the exerciser's body, and will not push the exerciser's legs towards the leg end 35 of the abdominal bench. If the gap 30 can be kept at a constant distance, the abdominal exercise performed on this particular abdominal bench will be an improvement over the abdominal exercises that can be accomplished using only a single pivot for the upper torso section.

In order to keep the gap 30 constant between the seat and torso cushions, a system of pivots, levers and rods has been devised. This system is best shown in FIG. 2.

The leg and footrest brace 3 pivots about pivot point 6 as shown in FIG. 2. Attached on top of the bottom end of the leg and footrest brace 3 is a push rod upper bracket 17. Pivotably attached to the upper push rod bracket 17 is the main push rod 16. This push rod 16 pivotably connects the leg and footrest brace 3 to the torso brace 15 in a unique manner.

The lower end of the pivoting push rod 16 is also pivotably connected to a lower push rod bracket 18. The push rod bracket 18 is fixedly connected to the L-shaped bracket 7. The push rod is also pivotably connected at its center to a center push rod pivot point 19. The center push rod pivot 19 is attached to left 1 and right 1' U-shaped braces as best shown in FIG. 2. The upper portion of push rod 16 is connected to the upper push rod bracket 17 at pivot point 20.

The lower end of the push rod is connected to the L-shaped bracket 7 at lower push rod pivot point 29 by the lower push rod bracket 18. This mechanical connection thus connects the leg and footrest brace 3 to the torso section of the device through the push rod 16.

In the preferred embodiment, left and right dog-leg levers 21 are pivotably connected to the L-shaped bracket 7 and hence the torso cushion brace 15. The upper section of the dog-leg lever 21 is pivotably connected to the torso brace 15 at upper dog-leg pivot point 25. The center of each left and right dog-leg levers 21 are also pivotably connected to the left and right sides, respectively, of the L-shaped torso bracket at pivot points 24. The system could utilize only one dog-leg lever, but at least two are preferred.

To further stabilize the pivot system, a pair of corresponding guide rods 22 are pivotably connected at the center push rod pivot point 19. The lower ends of these guide rods are pivotably connected to the corresponding dog-leg levers at the lower guide rod pivot point 23. The lower ends of the guide rods are pivotably connected to the lower ends of the respective dog-leg rods at the same point. The lower guide rod pivot point 23 and the lower dog-leg lever pivot point are the same pivot points, and both are designated as "23" in the drawing figures. While two guide rods are contemplated by this invention in the preferred embodiment, one guide rod could be used instead.

To further stabilize the torso brace 15, a short lever 26 is pivotably connected at one end near the outer end of the torso L-shaped bracket 7 at lower short lever pivot point 27. The upper portion of the short lever is connected to the torso brace 15 at upper short lever pivot point 28.

The mechanism set out above and described in the drawing Figures is designed to maintain the gap 30 at a constant distance during the exercise, despite the raising and lowering of the torso brace 15 (and cushion 14). As has been described earlier, maintaining this gap 30 at a constant distance greatly enhances the abdominal exercise, particularly as it relates to drawing in the legs by pulling on the leg brace 3. As the leg brace is drawn towards the abdomen during the exercise, the head end 34 of the torso section is also raised towards the abdomen. The constant gap ensures that the torso section of the exerciser is not forced towards the seat section Turning to FIGS. 3 and 4, the mechanism described and the mode of operation can be readily appreciated. As shown in FIG. 3, the exerciser would lay on the abdominal bench with his feet near the leg end 35 and his head near the head end 34. The exerciser's feet would be placed between the feet cushions 4 while the exerciser's hands would be placed around the handles 9. The gap 30 between the fixed seat 10 and the torso cushion 14 will remain constant as shown.

Figure 4:
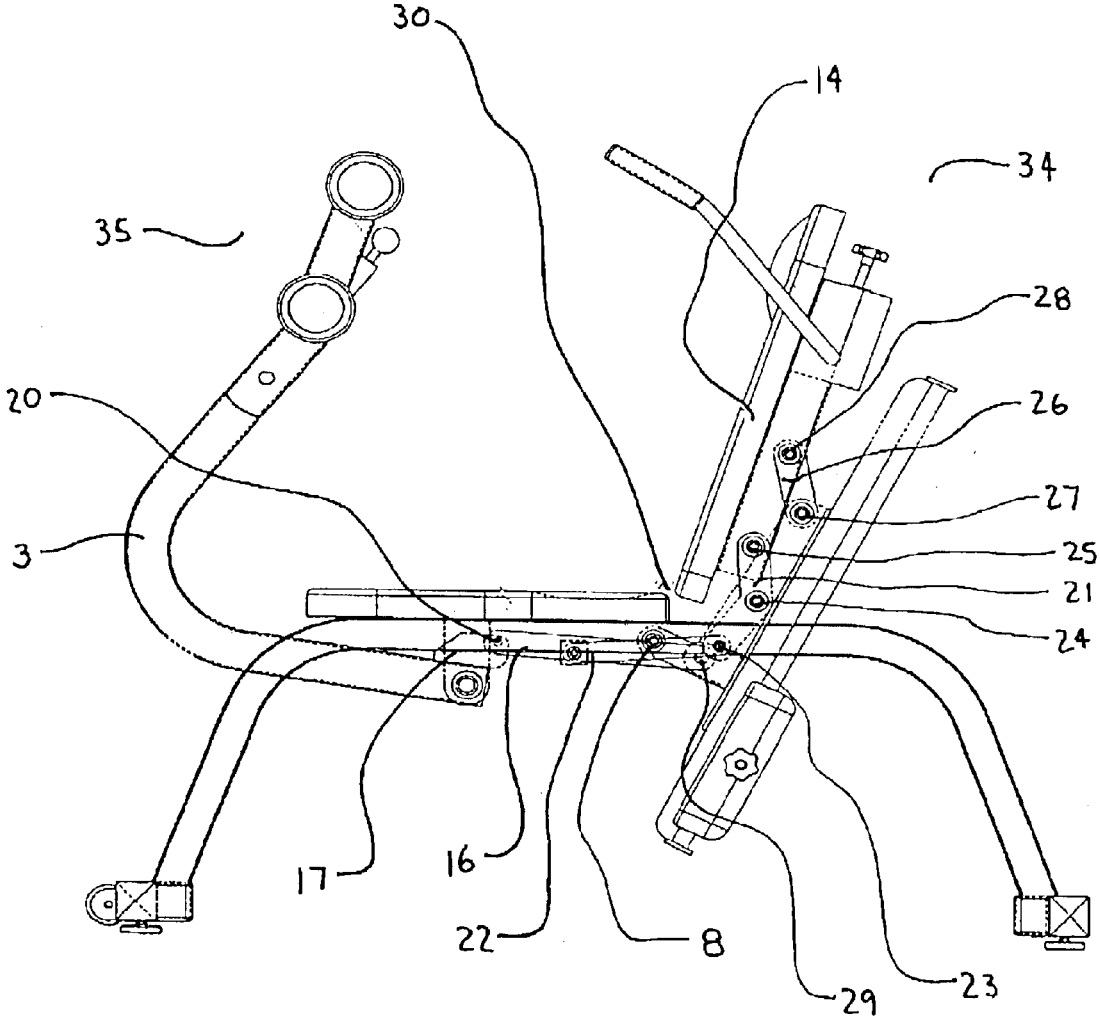
FIG. 4 is a side view of the abdominal bench, showing the pivoting system with the legs drawn in and the torso raised.

As the exerciser draws his legs in towards his abdomen and his torso upwards towards his abdomen, as shown in FIG. 4, the gap 30 between the fixed seat cushion 10 and the torso cushion 14 remains constant. As the foot brace 3 is pulled towards the abdomen, the push rod 16 causes the torso cushion 14 to oscillate. The various pivots, push rods, levers, and pivot points cause the cushions to remain at a constant distance.

The particular abdomen bench shown and described herein also has a footrest adjustment 31. This footrest adjustment 31 allows the foot rest to be raised and lowered or to be rotated slightly off line from the vertical. The footrest adjustment system 31 is the subject of other patents by this inventor.

The handle bar system shown in the drawing figures also has adjustable features that allow the handlebars to be raised or lowered by a quick release system. The handle bar adjustment means shown in this particular specification has been the subject of a more specific patent by this inventor.

Minor variations of the location and mechanical associations between the pivots, rods and levers would still be within the spirit and disclosure of this invention.

Having fully described my invention, I claim:

1. An abdominal bench with a fixed seat and a pivoting torso section, comprising:

a) a frame supporting a leg and footrest brace, a torso section, and a fixed seat;

b) a leg and footrest brace, pivotably connected to said frame, having a footrest end and a lower end, said lower end of said leg and footrest brace pivotably connected to a push rod;

c) a push rod pivotably connected at one end to said leg and footrest brace and at the other end to a torso bracket;

d) at least one guide rod pivotably connected at one end to said frame and at the other end to the lower end of a dog-leg lever;

e) a dog-leg lever, connected at an upper end to said torso brace, in the center to said torso bracket and at the lower end to at least one guide rod;

f) a short lever, pivotably connected at one end to a torso brace and pivotably connected at the other end to a torso bracket;

g) a torso bracket connected to said leg and footrest brace by said push rod, guide rod, dog-leg lever and short lever; and h) a torso cushion secured on top of said torso brace.

2. An exercise bench comprising:

a frame having a seat portion mounted thereon;

a torso portion pivotally engaged to the frame; and a multiple member linkage mechanism operably interconnecting the torso portion and the frame, the linkage mechanism being pivotally linked to the frame by at least two spaced apart frame pivot points and pivotally linked to the torso portion by at least two spaced apart torso pivot points, the linkage mechanism being constructed to permit the torso portion to be movable relative to the seat portion throughout a range of motion defining variable distances between the frame pivot points and the torso pivot points, and to permit a gap defined between the torso portion and the seat portion to remain substantially constant throughout the range of motion.

3. The exercise bench as defined in claim 2, wherein the multiple member linkage comprises a four bar linkage defining seven pivot points.

4. The exercise bench as defined in claim 3, wherein the four bar linkage includes first and second links having proximal ends pivotally engaged to the frame at the frame pivot points and third and forth links pivotally engaged to the torso portion at the torso pivot points, the first link being pivotally linked at a distal end thereof to a distal end of one of the third and fourth links and the second link being pivotally linked at a distal end thereof to a distal end of the other of the third and fourth links, and one of the first and second links and one of the second and third links being pivotally engaged with each other at intermediate pivot points thereon between their proximal and distal ends.

5. The exercise bench as defined in claim 2, wherein the exercise bench is an abdominal bench having a footrest mounted to the frame on a side thereof opposed to the torso portion.

6. The exercise bench as defined in claim 4, wherein the footrest is pivotally engaged to the frame and displaceable relative to the seat portion thereon.

7. The exercise bench as defined in claim 5, wherein the footrest is operatively linked to the torso portion.

8. The exercise bench as defined in claim 6, wherein the footrest and the torso portion are pivotal in conjunction relative to the seat portion.

9. The exercise bench as defined in claim 1, wherein an adjustable weight is engaged to the torso portion and displaceable therewith.

10. The exercise bench as defined in claim 8, wherein the adjustable weight is selectively displaceable relative to the linkage mechanism to vary resistance against pivotal movement of the torso portion.

11. The exercise bench as defined in claim 9, where positioning the adjustable weight on a first side of the linkage mechanism provides positive resistance and positioning the adjustable weight on a second side of the linkage mechanism opposite the first provides negative resistance.

12. The exercise bench as defined in claim 1, wherein grasping means are provided on the torso portion within reach of hands of a user in place on the exercise bench.

13. The exercise bench as defined in claim 11, wherein the grasping means comprise a pair of handles disposed near an end of the torso portion remote from the seat portion.

14. The exercise bench as defined in claim 1, wherein the seat portion is fixed in place to the frame.

15. The exercise bench as defined in claim 1, wherein the range of motion of the torso portion is defined between a rest position and a fully extended position, the torso portion being substantially aligned with the seat portion in said rest position and disposed at an angle relative to the seat portion in said fully extended position.

16. An exercise device having an upper torso supporting portion displaceable relative to a seat portion mounted to a frame, the device comprising a multiple member linkage mechanism pivotally engaging the torso supporting portion to the frame by at least two separated pivot points thereon, the torso supporting portion having a first end proximate the seat portion and a second end remote from the first end, the linkage mechanism being constructed to permit the torso supporting portion to be pivotally displaceable relative to the seat portion through a range of motion wherein each of the first and second ends travel through an arcuate paths having a variable radius of curvature, and to permit a gap defined between the first end of the torso supporting portion and the seat portion to remain substantially constant throughout said range of motion.

17. An exercise bench including a frame having a seat mounted thereon and a torso portion pivotally engaged to the frame by a linkage mechanism operable such that the torso portion is movable relative to the seat, the linkage mechanism comprising:

first and second links pivotally engaged to the frame at two spaced apart points thereon;

third and forth links pivotally engaged to the torso portion at two spaced apart points thereon;

the first link being pivotally linked to the third link and the second link being pivotally linked to the fourth link; and one of the first and second links and one of the third and fourth links being pivotally engaged with each other at intermediate pivot points thereon.

18. The exercise bench as defined in claim 16, wherein the linkage mechanism includes opposed pairs of each of the first, second, third and fourth links.

19. An exercise device comprising:

a frame having a seat portion mounted thereto; and a movable torso assembly mounted to said frame at a plurality of spaced apart pivot points disposed on said frame which pivotally interconnect the torso assembly to the frame such that the torso assembly is displaceable relative to the seat portion through an arcuate path having a variable radius of curvature, while a substantially constant gap is maintained between at least a portion of said torso assembly and at least a portion of said seat portion.

20. The exercise device as in claim 19 further including a movable weight mounted to said movable torso assembly so that weight resistance can be adjusted by movement of said movable weight.

21. The exercise device as in claim 20 wherein said torso assembly includes a main brace pivotally connected to said movable weight which is, in turn, pivotally connected to said frame.

22. The exercise device as in claim 21 wherein a portion of at least one pivotal connection between said main brace and said movable weight is independently connected to said frame.

23. The exercise device as in claim 22 wherein said at least one pivotal connection includes a bottom end pivotally connected to said frame.

24. The exercise device as in claim 23 wherein a separate link is used to form a connection between said bottom end and said frame.

25. The exercise device as in claim 19 further including at least one gripping member fixed to said movable torso assembly.

* * * * *